United States Patent [19]

Jou

[11] Patent Number: 4,787,072

[45] Date of Patent: Nov. 22, 1988

[54] STRUCTURE OF ELECTRONIC WATCH

[76] Inventor: Ming-Fu Jou, 27 Alley 2, Lane 437, Peitwen Rd., Taichung City, Taiwan

[21] Appl. No.: 40,336

[22] Filed: Apr. 20, 1987

[51] Int. Cl.[4] ..... G04B 19/00; G04B 47/00

[52] U.S. Cl. ..... 368/76; 368/10; 324/168; 335/205

[58] Field of Search ..... 368/76, 810, 157, 160, 368/10, 223, 228, 107, 113; 324/160, 166, 168; 335/205, 207

[56] References Cited

U.S. PATENT DOCUMENTS

| | | | |
|---|---|---|---|
| 3,719,887 | 3/1973 | Shimizu et al. | 335/207 |
| 4,027,278 | 5/1977 | Gianhini | 335/207 |
| 4,197,748 | 4/1980 | Stenehem | 324/168 |
| 4,369,385 | 1/1983 | Malkin et al. | 368/160 |
| 4,646,042 | 2/1987 | Eshelman | 335/205 |
| 4,680,514 | 7/1987 | Supler | 368/160 |

*Primary Examiner*—Vit W. Miska
*Attorney, Agent, or Firm*—Bucknam and Archer

[57] ABSTRACT

In an electronic watch, a sensor of the closed type which consists of an upper circular cover (10), a shell (20), a rotary turning disk (30), clamped between the upper cover and shell, the shell having a socket (23) on one side, a reed switch (50) enclosed in the socket, the turning disk forming a concave trough (31), a pair of magnets (40) located laterally in the concave trough, an axial shaft, the shell having a first central orifice (21), the axial shaft being held in the orifice, a plier (32) extending from the side of the turning disk, the upper cover having a pair of lugs, the shell having a pair of second orifices on each side of the central first orifice (21), the lugs penetrating the second orifices, an external axial wheel, the plier (32) engaging the axial wheel.

1 Claim, 2 Drawing Sheets

STRUCTURE OF ELECTRONIC WATCH

BRIEF SUMMARY OF THE INVENTION

The chief feature of the project is to simplify the structure, the watch is composed by the components of upper cover, permanent magnet, outer shell and the reed switch built in the outer shell. Based on this improvement, the sensor is of the closed type with the merits of high precision and high quality.

BACKGROUND OF THE INVENTION

The feature of the structure of the sensor of electronic watch is to use the magnetic flux inducing the reed switch via the function of the insulation and conductive contact of the induction holes reserved on the turning disk to make the legs of the reed switch to effect insulating and contacting, and then transmit the signals sensitively to the receiver (electronic watch). An athlete may be able to read the figures directly. The sensors sold in the present market have the following defects:

1. The design and structure of the parts is complicated and there are too many fittings and components including chiefly socket rings, outer cushion rings, turning disk, magnet, reed switch, shell cover, etc., and the design of the structure of the socket rings and the outer cushion rings are complicated, and they are difficult to manufacture.

2. It is eady to produce the noise of friction during running; the area of the well is considerable large and the surface it covers exceeds the area of the socket rings and outer cushion rings.

In such case, other than the noise of friction produced at the edges of the socket rings and the outer cushion rings during operation, it is also easy to be disturbed and damaged by external objects, and the area extended is waste of raw material.

3. Due to its exposure, the tallow may easily flow out after a period of use, and noise is produced due to dust and this affects the quality seriously.

DETAILED DESCRIPTION

Figure 1:
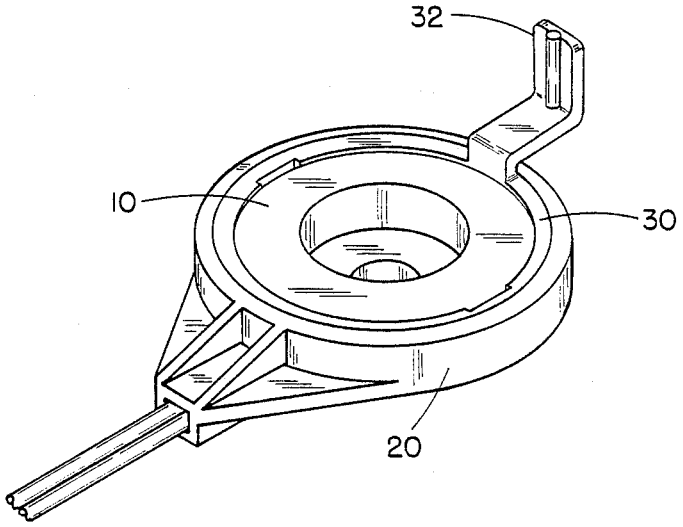

In view of the fact that the known products have the above defects in practical use, the inventor offers the ideal new design of "the Project to make an addition of sensor structure combination for an electronic watch", the detailed description of the drawings of best examples of tructure attached is given as follows:

Drawing 1. A perspective drawing of the structure of sensor

Drawing 2. Detailed drawing of the structure of sensor

Drawing 3. Sectional drawing of the structure of sensor

As drawings 1 to 3 show, the invention includes one set of parts to be tenoned and matched mutually, such as, upper cover 10, shell 20, the rotary turning disk 30 clamped between upper cover 10 and shell 20, two permanent magnets 40 and reed switch 50. Shell 20 is integrally molded of plastic, and has penetrating hole 21 on its edge surface to connect with the axial shaft, and matching holes 22 on appropriate positions on either sides to be used for tenoning and matching mutually of the upper cover 10 and pliers 11. There is an extensive socket 23 on the extended part on the side edge of shell 20 to enclose the reed switch 50.

The reed switch 50 is placed into the closed extensive socket 23 of shell 20 to keep clean and sensitive.

The turning disk 30 is installed in the inner side socket ring of shell 20, and there is a concave trough 31 on the side of the end surface of turning disk 30 to enclose permanent magnet 40. Besides, a plier 32 is extended from the end of the side edge of turning disk 30 for the convenience of external axial wheel.

The upper cover 10 is a circular object similar roughly to a hat, and the end surface of bottom side is stage like and empty inside, the advantage is that the cylinder part of the middle section is able to penetrate the empty portion of the turning disk 30 to prevent the defect of the clearance of matching of the upper cover 10 and the turning disk 30 being too big to incur swaying.

Figure 3:
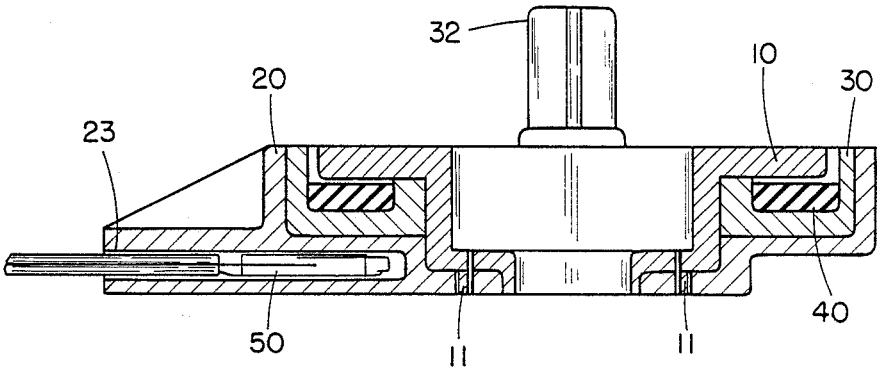
Figure 2:
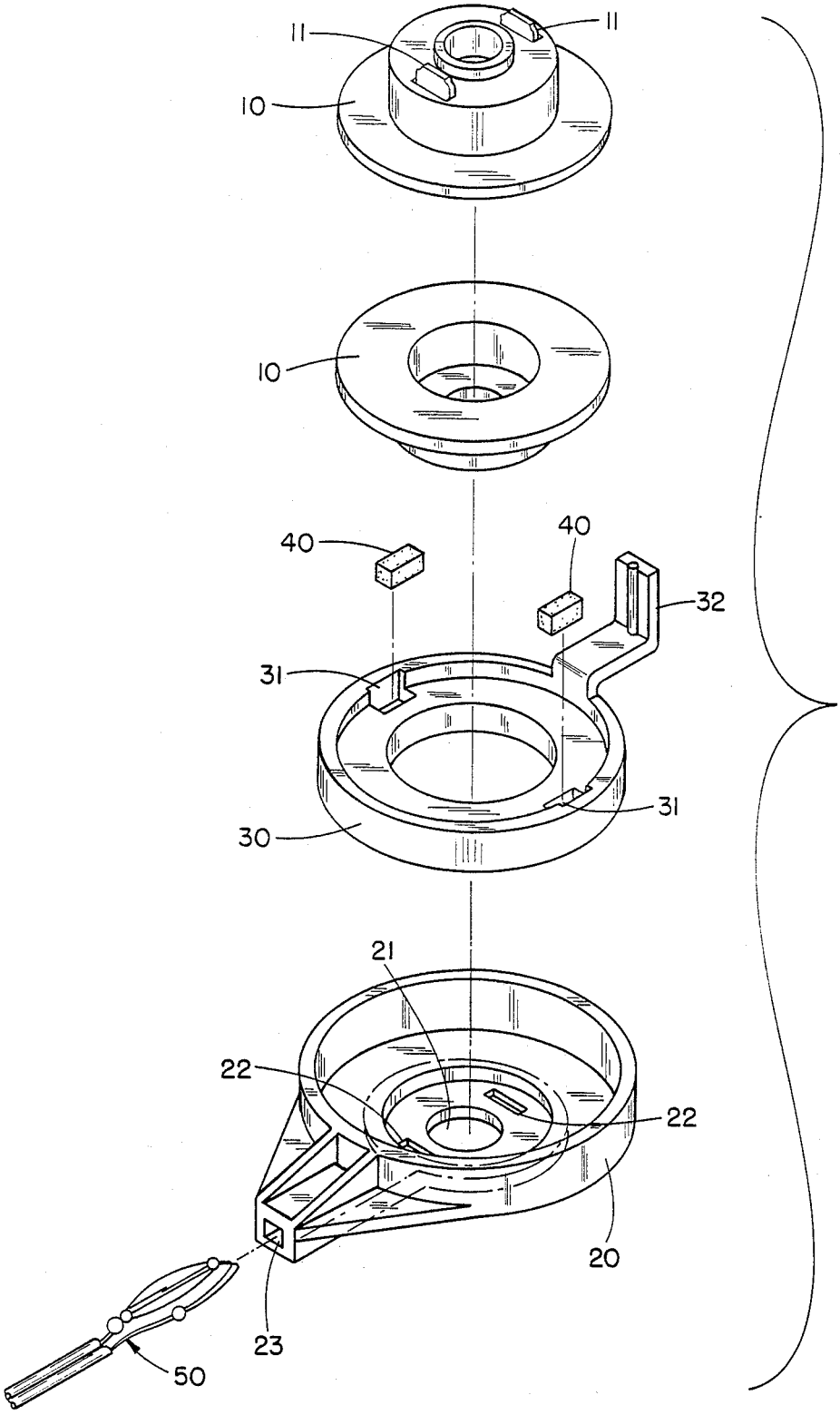

As FIG. 3 shows, based on the above description, after completion of the parts of varied portions, the magnet 40 on the turning disk will produce the effect of contacting and induction due to being magnetized with the built-in reed switch on the inner side of the shell 20. Therefore, it may transmit the message induced from the movement to the display of the electronic watch. The upper cover 10, turning disk 30, magnet 40 and reed switch 50 are all installed in a hidden state. Especially the design of the accessories is based on the principle of not protruding from the shell 20 and it provides safety and good appearance by reducing the volume.

Based on the above description, the invention is intended at to improve the complicated known articles to make the design more practical with excellent quality. The structure is new and ideal especially the closed type structure prevents the entering of dust and it is silent and noiseless during operation.

I claim:

1. In an electronic watch, a sensor of the closed type which consists of an upper circular cover (10), a shell (20), a rotary turning disk (30), clamped between said upper cover and said shell, said shell having a socket (23) on one side, a reed switch (50) enclosed in said socket, said turning disk forming a concave trough (31), a pair of magnets (40) located laterally in said concave trough, an axial shaft, said shell having a first central orifice (21), said axial shaft being held in said orifice, a plier (32) extending from the side of said turning disk, said upper cover having a pair of lugs, said shell having a pair of second orifices on each side of said central first orifice (21), said lugs penetrating said second orifices, an external axial wheel, said plier (32) engaging said axial wheel.

* * * * *